US006875061B2

(12) United States Patent
Daugherty et al.

(10) Patent No.: US 6,875,061 B2
(45) **Date of Patent: *Apr. 5, 2005**

(54) ELECTRICAL CLIP CONNECTOR COMPRISING EXPANDABLE BARREL SEGMENT

(75) Inventors: James D. Daugherty, Brookfield, OH (US); Thomas M. Nadasky, Berlin Center, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/955,878

(22) Filed: Sep. 30, 2004

(65) Prior Publication Data

US 2005/0042937 A1 Feb. 24, 2005

Related U.S. Application Data

(63) Continuation of application No. 10/350,666, filed on Jan. 24, 2003.

(51) Int. Cl.[7] ..... H01R 4/40

(52) U.S. Cl. ..... 439/769; 439/726; 439/757

(58) Field of Search ..... 439/769, 757, 439/772, 754, 756, 726, 559, 854, 855

(56) References Cited

U.S. PATENT DOCUMENTS

| | | | | | |
|---|---|---|---|---|---|
| 5,389,466 | A | * | 2/1995 | Inoue et al. | 429/178 |
| 5,556,309 | A | * | 9/1996 | Sharpe et al. | 439/759 |
| 5,788,543 | A | | 8/1998 | Rudoy et al. | 439/854 |
| 6,086,385 | A | | 7/2000 | Wang et al. | 439/69 |
| 6,142,813 | A | | 11/2000 | Cummings et al. | 439/374 |
| 6,162,085 | A | | 12/2000 | Chugh et al. | 439/467 |
| 6,171,146 | B1 | | 1/2001 | Fink et al. | 439/595 |
| 6,179,658 | B1 | | 1/2001 | Gunay et al. | 439/587 |
| 6,203,364 | B1 | | 3/2001 | Chupak et al. | 439/527 |
| 6,208,233 | B1 | | 3/2001 | Stein, Sr. et al. | 338/195 |
| 6,247,951 | B1 | | 6/2001 | Di Liello et al. | 439/329 |
| 6,247,965 | B1 | | 6/2001 | Cummings et al. | 439/587 |
| 6,305,957 | B1 | | 10/2001 | Fink et al. | 439/157 |
| 6,338,651 | B1 | | 1/2002 | Svette, Jr. et al. | 439/559 |
| 6,345,706 | B1 | | 2/2002 | Oliver et al. | 188/282.2 |
| 6,406,307 | B2 | | 6/2002 | Bungo et al. | 439/130 |
| 6,443,137 | B1 | | 9/2002 | Kraft et al. | 123/634 |
| 6,454,060 | B1 | * | 9/2002 | Lisenker et al. | 521/41 |
| 6,478,634 | B2 | | 11/2002 | Fukuda | 439/761 |
| 6,494,751 | B1 | * | 12/2002 | Morello et al. | 439/752 |
| 6,508,666 | B1 | * | 1/2003 | Francis | 439/548 |
| 6,533,588 | B1 | * | 3/2003 | Woith et al. | 439/67 |
| 6,533,611 | B2 | * | 3/2003 | Morello et al. | 439/595 |
| 6,535,396 | B1 | * | 3/2003 | Degenkolb et al. | 361/775 |
| 6,556,118 | B1 | * | 4/2003 | Skinner | 336/182 |
| 6,565,372 | B2 | * | 5/2003 | Bakker et al. | 439/157 |
| 6,578,444 | B1 | * | 6/2003 | Wendelin | 74/495 |
| 2001/0031585 | A1 | * | 10/2001 | Murakami et al. | 439/756 |

* cited by examiner

*Primary Examiner*—Hae Moon Hyeon
(74) *Attorney, Agent, or Firm*—David P. Wood

(57) ABSTRACT

An electrical clip connector has a terminal clip which is electrically mated to a ground stud by hand. The terminal clip is protected by an erogonomically friendly housing which supports the functional requirements of the terminal clip. The housing has a hoop portion which defines a through hole orientated concentrically to a bore defined by a resilient barrel segment of the terminal clip. Communicating transversely with the rough hole is a channel carried by a first portion of the housing which encases a first arm of the terminal clip engaged to a circumferential first end of the barrel segment. A second or activation arm of the terminal clip extends from an opposite end of the barrel segment and crosses over the first arm so that compression of the arms toward one-another causes the loop segment to enlarge for receipt of the ground stud. The second arm is encased by a second portion of the housing which is preferably hinged to the first portion near the hoop portion. When the clip connector is fully compressed, contact between the first and second portions prevent damage or deformation of the terminal clip which could degrade the electrical connection.

9 Claims, 2 Drawing Sheets

ELECTRICAL CLIP CONNECTOR COMPRISING EXPANDABLE BARREL SEGMENT

CROSS REFERENCE TO RELATED APPLICATION

The present application is a continuation application of U.S. application Ser. No. 10/350,666 filed on Jan. 24, 2003.

TECHNICAL FIELD

The present invention relates to an electrical clip connector and more particularly to a ground electrical clip connector for an automotive ground stud.

BACKGROUND OF THE INVENTION

Conventional electrical grounding methods within the automotive industry include a connection having a ring terminal held to a threaded stud with a threaded nut. The electrical contact is created between the ring terminal and the body sheet metal by applying torque to the nut which applies an axial force upon the ring terminal. Thus a reliable connection is dependent upon the amount of torque applied to the nut. Because this is controlled in the power nut driver used at the assembly plant, frequent calibration of the nut driver is required to assure compliance to the torque specification. Unfortunately, inadvertent mis-alignment of the nut to the threaded stud can cause cross-threading between the nut and the stud which will cause a false torque reading and potentially a bad connection. Moreover, tools such as a nut driver are cumbersome within a manufacturing environment and lead to increase maintenance and labor expenses.

However, a hand pluggable ground connection or terminal clip such as that disclosed in Hurdoy, U.S. Pat. No. 5,788,543, issued Aug. 4, 1998, do not require the cumbersome and costly use of calibrated tools. The disclosed terminal clip has a barrel portion sized to fit over a stud having a prescribed diameter. To mate with the stud, the terminal clip also has an activation arm which when depressed expands the barrel portion to a diameter that is larger than the diameter of the stud and therefore capable of fitting over the stud. In this expanded state the terminal is slid down the length of the stud until the top of the stud extends above the barrel portion of the terminal clip. Once aligned axially to the stud, the activation arm is released causing the barrel portion of the terminal to exert a spring induced radial force upon the stud as it tightens around the stud circumference.

Unfortunately, the exposed state of the metallic terminal clip leaves it prone to damage from adjacent obstacles. Moreover, the sharp edges and snagging interfaces of the terminal clip can snag adjacent wires causing wire insulation chaffing or which may prevent the activation arm from fully releasing after being depressed. Moreover, if the activation arm is depressed to far, the terminal clip may be inadvertently damaged via plastic deformation, loosing some of its resiliency necessary to provide a reliable electrical connection. Yet further, the activation arm is not ergonomically friendly to the user in the assembly plant and in its exposed condition is susceptible to damage due to shipping and handling.

SUMMARY OF THE INVENTION

An electrical clip connector has a terminal clip which is electrically mated to a ground stud by hand. The terminal clip is protected by an erogonomically friendly housing which supports the functional requirements of the terminal clip. The housing has a hoop portion which defines a through hole orientated concentrically to a bore defined by a resilient barrel segment of the terminal clip. Communicating transversely with the through hole is a channel carried by a first portion of the housing which encases a first arm of the terminal clip engaged to a circumferential first end of the barrel segment. A second or activation arm of the terminal clip extends from an opposite end of the barrel segment and crosses over the first arm so that compression of the arms toward one-another causes the barrel segment to enlarge for receipt of the ground stud. The second arm is encased by a second portion of the housing which is preferably hinged to the first portion near the hoop portion. When the clip connector is fully compressed, contact between the first and second portions prevent damage or deformation of the terminal clip which could degrade the electrical connection.

Advantages of the present invention include a clip connector having a novel housing which protects a terminal clip from inadvertent damage due to over deflection, provides consistent deflection regardless of wire gauge size, protects surrounding wires from insulation chaffing, and enhances the ergonomics making the connector user friendly in the assembly plant.

BRIEF DESCRIPTION OF THE DRAWINGS

The presently preferred embodiments of the invention are disclosed in the following description and in the accompanied drawings, wherein.

DETAILED DESCRIPTION OF THE PREFERRED EMBODIMENTS

Figure 1:
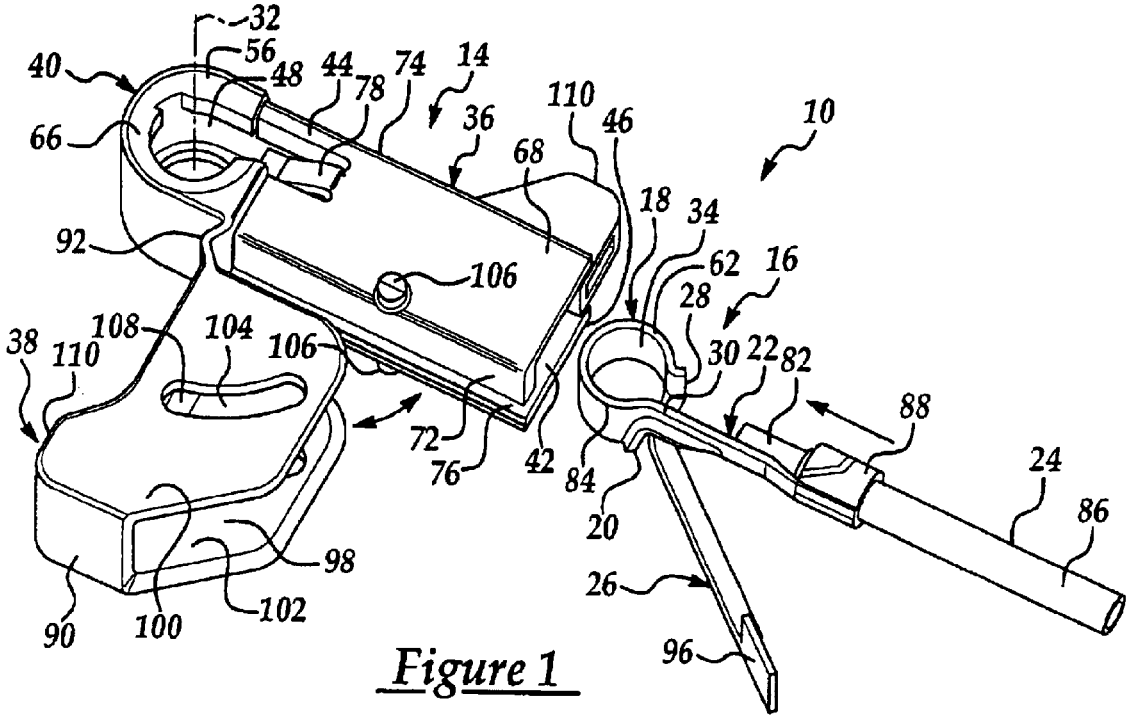
FIG. 1 is in an exploded perspective view of an electrical clip connector of the present invention.
Figure 2:
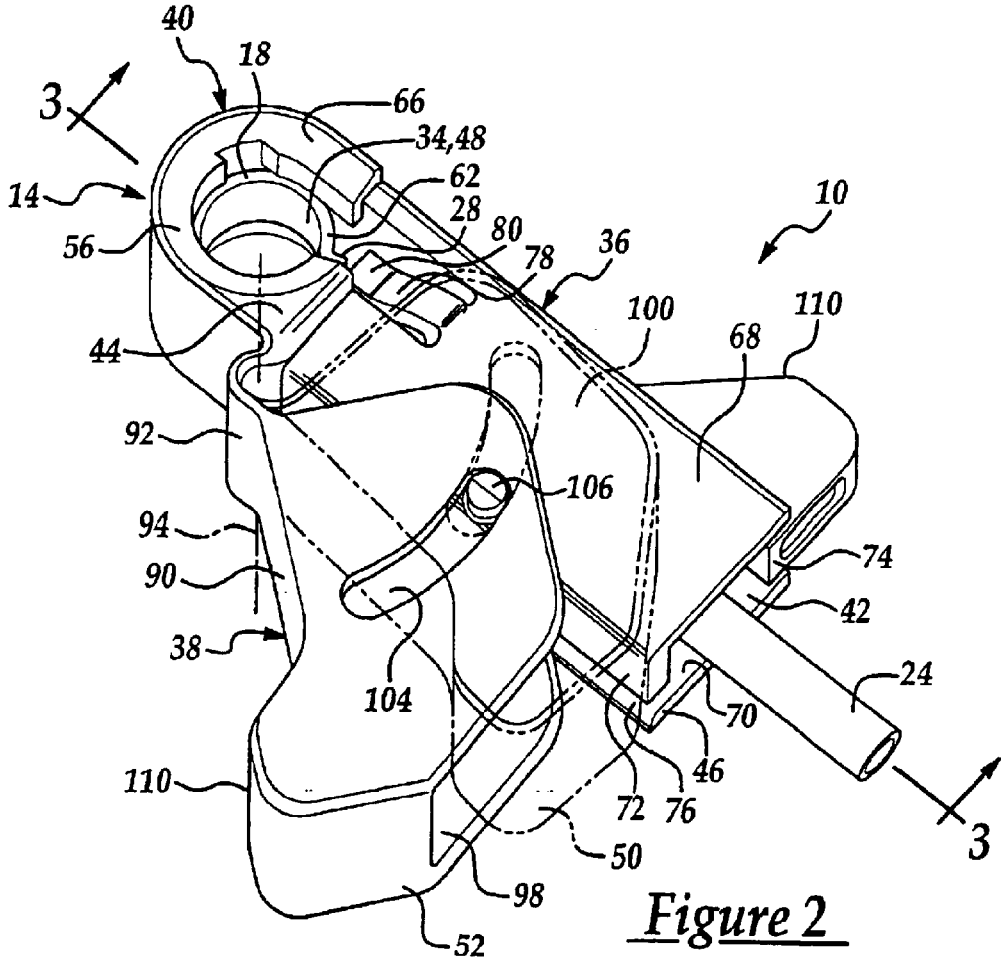
FIG. 2 is a perspective view of the electrical clip connector shown in a released state and in a compressed state which is illustrated in phantom.
Figure 3:
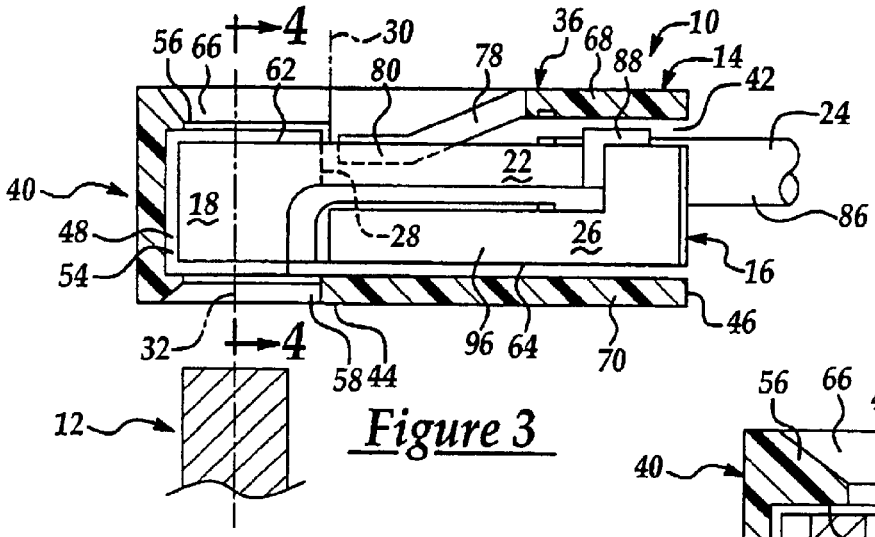
FIG. 3 is a cross section of the electrical clip connector taken along line 3—3 of FIG. 2.

Referring now to the drawings, FIGS. 1–3 illustrate an electrical clip connector 10 capable of securing electrically to a protruding ground stud 12 preferably within an automotive environment. The clip connector 10 has a housing 14 which substantially encases a terminal clip 16 capable of repeated matings to the ground stud 12, with a repeating predefined normal force, by hand and without the use of tools. The terminal clip 16 has a barrel segment 18 which wraps circumferentially about the stud 12 at slightly less than three hundred and sixty degrees to electrically engage the stud. A first end 20 of the barrel segment 18 engages unitarily to a radially outward projecting first arm 22 that engage electrically to an insulated wire 24. A second or activation arm 26 projects substantially tangentially from the barrel segment 18 and outward from a second end 28 of the barrel segment 18, thus crossing under the first arm 22 at an intersection or crossing point 30 located radially outward from a central axis 32 of a void or open ended bore 34 defined by the barrel segment for receiving the stud 12. When the first and second arms 22, 26 are compressed toward one another, the void 34 expands radially outward with respect to the central axis 32 in order for the barrel segment 18 to slip over the stud 12 during mating of the connector 10.

Substantially encasing and protecting the elongated first and second arms 22, 26 and the barrel segment 18 of the terminal clip 16 are respective elongated first and second portions 36, 38 and a hoop or shoe-horn portion 40 of the housing 14. The housing 14 is preferably made of a one-piece injected molded plastic which provides an electrically insulating barrier. The first portion 36 is generally open ended and hollow defining a generally square cross-sectioned channel 42 which communicates longitudinally between an open base end 44 and an open distal end 46 of the first portion 36, and extends radially outward with respect to the central axis 32. The base end 44 engages unitarily to the shoe-horn portion of the housing which defines a generally round through hole 48 that co-extends with the bore 34 and shares the common central axis 32 when the connector 10 is assembled and mated. The channel 42 communicates transversely with the through hole 48. During assembly of the connector 10, the barrel segment 18 of the terminal clip 16 is first inserted through the open distal end 46 of the first portion 36, through the channel 42, through the base end 44, and into the through hole 48. Once inserted, the shoe-horn portion 40 substantially houses and concentrically aligns the barrel segment 18 to the central axis 32, and the first portion 36 substantially houses the first arm 22 of the terminal clip 16. The wire 24 projects from the first arm 22 and through the open distal end 46 of the first portion 36 of the housing 14.

Figure 4:
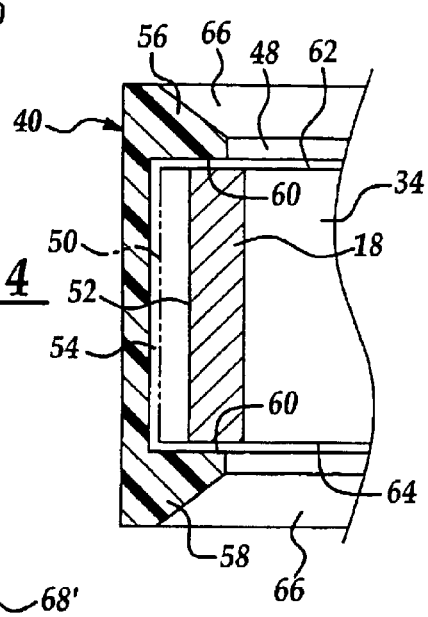
FIG. 4 is a partial cross section of the electrical clip connector taken along line 44 of FIG. 3.

Referring to FIGS. 2 and 4, the through hole 48 is sized radially to accept the barrel segment 18 when the first and second arms 22, 26 are in a fully depressed state 50. Thus, when the first and second arms 22, 26 are in a fully released state 52, a radial clearance 54 exists between the barrel segment 18 of the terminal clip 16 and the shoe-horn portion 40 of the housing 14 accounting for the reduced diametric size of the terminal clip bore 34. The barrel segment 18 is in-part held axially within the through hole 48 by top and bottom circumferential shoulders 56, 58 which project radially inward into the through hole. Each shoulder 56, 58 carries a substantially annular face 60 which substantially covers and directly opposes respective top and bottom edges 62, 64 of the terminal clip 16 located at the barrel segment 18. Therefore, the shoulders 56, 58, in addition to aligning the barrel segment 18 axially, also protect the edges 62, 64 of the barrel segment from possible damage created by external forces. Because the clip connector 10 can receive the stud 12 from either above or below, disposed opposite each annular face 60 is a circumferential bevel or chamfer 66 which helps concentrically align the stud 12 to the through hole 48.

The substantially square shape of the traversing cross-section of the channel 42 of the first portion 36 of the housing 14 is generally defined by a top wall 68, a bottom wall 70, a clockwise orientated or inward sidewall 72, and an opposite counter-clockwise orientated or outward sidewall 74. The inward sidewall 72 has a slot 76 which communicates laterally with the channel 42 and extends longitudinally from the base end 44 and through the open distal end 46. The slot 76 provides the necessary clearance for the second arm 26 of the terminal clip 16, permitting the first arm 22 to be slid radially inward into the channel 42 as previously described.

To assemble, the terminal clip 16 inserts into the channel 42 of the first portion 36 of the housing 14 until it snap locks radially to the housing. The terminal clip 16 is thus held radially with respect to the central axis 32 between the hoop portion 40 of the housing and a cantilevered lock arm 78 of the top wall 68 which projects radially inward toward and slightly beyond the base end 44 from a mid-part of the top wall. The lock arm 78 also projects at a slight angle into the channel 42 so that during insertion of the terminal clip 16 into the channel 42, the top edge 62 of the barrel segment 18 engages the angled lock arm 78 causing it to resiliently flex upward out of the channel 42. Continued insertion of the terminal clip 16 orientates the second end 28 of the barrel segment 18 radially inward of and adjacent to a distal head 80 of the lock arm 78, at which point the lock arm 78 snaps back into the channel 42 placing the distal head 80 in radial contact with the second end 28 of the barrel segment 18.

Preferably, and prior to insertion of the terminal clip 16 into the channel 42, a non-ferrous core 82 at a distal end of the insulated wire 24 is engaged electrically to a circumferential outward side 84 of the first arm 22, and an insulation jacket 86 of the wire 24 adjacent to the distal end is crimped to a distal end of the first arm 22 of the terminal clip 16 via crimp wings 88 of the first arm. The electrical engagement of the core 82 can be accomplished via sonic welding, soldering or any conventional type of electrical connection. The crimp wings 88 are sized to accept a wide range of wire gauges, and likewise the first portion 36 of the housing 14 is designed to adjustably accept a similar if not wider range of wire gauges.

The outward sidewall 74 of the first portion 36 of the housing 14 is generally a cantilevered member projecting radially outward from the base end 44. The cantilevered outward sidewall 74 flexes to accept a wide range of wire gauges and is thus not engaged directly to either the top or bottom walls 68, 70 but instead projects radially outward from the base end 44. The cantilevered outward wall 74 resiliently flexes in a circumferential counter-clockwise direction, thus increasing the cross section of the channel, to accept larger wire gauge sizes precrimped to the distal end of the first arm 22.

When the terminal clip 16 is moved between the compressed and released states 50, 52, the second portion 38 of the housing 14 must move substantially with the activation or second arm 26 of the terminal clip 16 for which it encases. An elongated barrier wall 90 of the second portion 38 engages pivotally to the base end 44 of the first portion 36 at the inward sidewall 72 via a resilient hinge 92. The hinge 92 is disposed radially inward from and adjacent to the end of the slot of the first portion 36. Preferably, the hinge 92 is unitary to both the first and second portions 36, 38 so that the housing 14 is a one piece injection plastic molded part. The barrier wall 90 of the second portion 38 projects radially outward with respect to a pivoting axis 94 of the hinge 92 and generally away from the central axis 32. The barrier wall 90 extends laterally in a vertical direction which as illustrated is parallel to the pivoting axis 94 of the hinge 92. The pivoting axis 94 is disposed substantially parallel to the central axis 32. Because the pivoting axis 94 is spaced circumferentially from the crossing point 30 of the first and second arms 22, 26 of the terminal clip 16 with respect to the central axis 32, a circumferential outward side 96 of the second arm 26 slides directly against the barrier wall 90 as the terminal clip 16 moves between the compressed and released states 50, 52.

The second arm 26 is disposed operatively within an alcove 98 of the second portion 38 of the housing 14 defined circumferentially by the barrier wall 90, and axially between a clockwise projecting horizontal top flap 100, and a clockwise projecting horizontal bottom flap 102 of the second portion 38. The barrier wall 90 extends laterally between the top and bottom flaps 100, 102. Because the top flap 100 is disposed adjacent to and above the top wall 68 of the first portion 36 and the parallel bottom flap 102 is disposed adjacent to and below the bottom wall 70 of the first portion 36, the first portion moves increasingly into the alcove 98 as the clip connector 10 moves from the released state 52 into the compressed state 50.

To stabilize the pivoting action of the second portion 38 with respect to the first portion 36 of the housing 14 each flap 100, 102 carries a close ended groove 104 which extends circumferentially with respect to the pivoting axis 94. When the clip connector 10 is assembled, the groove 104 of the top flap 100 is in receipt of a pin 106 of the first portion 36 which projects upward from the top wall 68 and the groove 104 of the bottom flap 102 is in receipt of an opposite pin 106 of the first portion 36 which projects downward from the bottom wall 70. The pins travel within their respective grooves 104 as the clip connector 10 moves between the compressed and released states 50, 52. Although not illustrated, the housing 14 of the clip connector 10 is capable of functioning without the resilient hinge 92, however, this is not preferred since it would produce a two-part housing and sacrifice some stability of the overall connector.

A rib 108 of the second portion 38 contacts the inward sidewall 72 of the first portion 36 when the clip connector 10 is in the fully compressed state 50. This contact prevents over compression and permanent deformation of the activation arm 26 which could limit expansion of the barrel segment, thus impairing receipt of the stud during the mating process. The rib contact also prevents over expansion and plastic deformation of the barrel segment 18 which would impair electrical continuity between the stud 12 and the terminal clip 16 by reducing the normal force that the resiliency or bias of the barrel segment 18 places on the stud 12. The elongated rib 108 projects laterally outward from the barrier wall 90 into the alcove 98 in a counter clockwise direction and extends longitudinally parallel to the activation arm 26. The rib 108 is disposed above the activation arm 26 and is aligned axially above the slot 76 of the first portion 36 through which the activation arm 26 projects. This alignment orientates the rib 108 axially to the inward sidewall 72 of the first portion 36 to achieve contact to the sidewall above the slot 76.

The cantilevered outward sidewall 74 of the first portion 36 of the housing 14 and the barrier wall 90 of the second portion 38 are both contoured to include grasping tabs or pads 110 which assist the user in mating and un-mating the clip connector by hand to the stud 12. To mate and un-mate the connection, the operator's finger and thumb are in contact with respective pads 110, located at easily identifiable end points of the first and second portions 36, 38 of the housing 14 for maximum leverage. As the operator applies a squeezing force the barrel segment 18 of the terminal clip 16 expands creating a clearance between the clip 16 and the stud 12.

When the clip connector clip is assembled, the top and bottom flaps 100, 102 of the second portion 38 of the housing 14 prevent the ingress of obstacles between the first and second arms 22, 26 of the terminal clip 16 which could impair compression of the clip. Moveover, rounded corners and edges of the housing are less likely to chaff the insulation jackets of surrounding wires.

Figure 5:
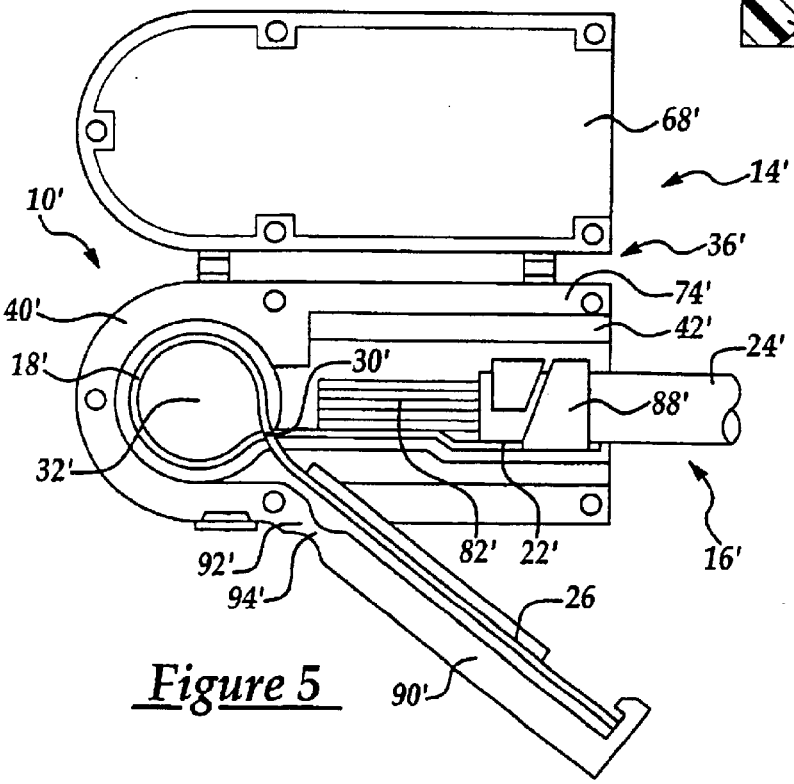
FIG. 5 is a perspective view of a second embodiment of an electrical clip connector.

Referring to FIG. 5, a second embodiment of the connector clip 10' is illustrated having a variety of alternative features. For instance, a top wall or lid 68' of a first portion 36' of a housing 14' is hinged to an outward wall 74' of the first portion 36'. In this arrangement, a terminal clip 16' is inserted laterally into a channel 42' of the first portion 36' prior to snap locking the lid 68' closed. Contrary to the first embodiment, the lid 68' does not have a lock arm to hold the terminal clip 16' radially in place. Instead, a hoop portion 40' of the housing 14' circumferentially surrounds a barrel segment 18' of the terminal clip 16' by greater than one hundred and eighty degrees, thus preventing the terminal clip from moving radially outward and longitudinally along the channel 42'.

While the forms of the invention herein disclosed constitute presently preferred embodiments, many others are possible. For instance, the second arm 26 of the terminal clip can be engaged electrically to a second clip wire, in a fashion similar to the first arm. It is not limited herein to mention all the possible equivalent forms or ramifications of the invention. It is understood that the terms used herein are merely descriptive rather than limiting and that various changes may be made without departing from the spirit or scope of the invention.

What is claimed is:

1. An electrical clip connector for electrically engaging a stud, the clip connector comprising:

a non-ferrous terminal clip having a first arm, a second arm, an expandable barrel segment engaged between the first and second arms, and a void defined by the barrel segment for receiving a ground stud, wherein the barrel segment is engaged resiliently and circumferentially about the ground stud when the first and second arms are in a released state;

wherein the first arm projects from a first end of the barrel segment and the second arm projects from a second end of the barrel segment and crosses over the first arm so that movement of the first and second arms toward one another causes the void to expand radially outward until the arms reach a compressed state and the barrel segment to dis-engage from the stud;

a housing having an elongated first portion encasing the first arm, a second portion encasing the second arm, and a hoop portion extending circumferentially about the barrel segment, wherein the first portion is engaged to the second portion via a hinge that is unitary to the first and second arms and wherein the first portion includes an open distal end and an opposite base end engaged to the hinge and defines a channel extending longitudinally between and communicating through the base and distal ends, the first portion further contacts the second portion when the first and second arms are in the compressed state; and wherein said hoop portion is engaged to the base end of the first portion.

2. The electrical clip connector set forth in claim 1 wherein the housing is made of injection molded plastic.

3. The electrical clip connector set forth in claim 1 wherein the void defined by the expandable barrel segment comprises a central axis co-extending with the stud; and comprising a pivoting axis about which the hinge pivots, the pivoting axis being aligned parallel to the central axis.

4. The electrical clip connector set forth in claim 1 comprising:

a cantilevered lock arm of the first portion projecting toward the base end and angling into the channel;

wherein a distal head of the flex arm is disposed within the channel and radially engages the barrel segment of the terminal clip; and wherein the barrel segment is engaged radially between the hoop portion and the distal head of the flex arm thereby limiting radial movement of the terminal clip with respect to the housing.

5. The electrical clip connector set forth in claim 1 comprising:

a top wall of the first portion of the housing having an outward projecting pin disposed parallel to the pivoting axis; and a top flap of the second portion disposed perpendicular to the pin, the top flap having a groove extending circumferentially with respect to the pivoting axis, wherein the pin projects into the groove.

6. The electrical clip connector set forth in claim 5 comprising:

a bottom wall of the first portion of the housing having an outward projecting pin disposed parallel to the pivoting axis; and a bottom flap of the second portion disposed perpendicular to the pin of the bottom wall, the bottom flap having a groove extending circumferentially to the pivoting axis, wherein the pin of the bottom wall projects into the groove of the bottom flap.

7. The electrical clip connector set forth in claim 6 wherein the second portion of the housing has an elongated barrier wall extending longitudinally from the hinge.

8. The electrical clip connector set forth in claim 7 wherein the barrier wall extends laterally between the top and bottom flaps.

9. The electrical clip connector set forth in claim 8 wherein the sidewall and the top and bottom flaps of the second portion define an alcove which receives the first portion of the housing when the terminal clip is in the compressed state.

* * * * *